United States Patent [19]

Klüttermann et al.

[11] Patent Number: 4,691,413

[45] Date of Patent: Sep. 8, 1987

[54] SLIVER COILER

[75] Inventors: Jürgen Klüttermann; Hermann Trützschler, both of Monchen-Gladbach, Fed. Rep. of Germany

[73] Assignee: Trützschler GmbH & Co. KG, Monchen-Gladbach, Fed. Rep. of Germany

[21] Appl. No.: 862,241

[22] Filed: May 12, 1986

[30] Foreign Application Priority Data

May 11, 1985 [DE] Fed. Rep. of Germany ..... 3517058

[51] Int. Cl.[4] ..... B65H 54/80

[52] U.S. Cl. ..... 19/159 R; 19/288

[58] Field of Search ..... 19/159 R, 288, 159 A, 19/157

[56] References Cited

U.S. PATENT DOCUMENTS

| | | | |
|---|---|---|---|
| 2,630,243 | 3/1953 | Longstreet . | |
| 2,719,338 | 10/1955 | Carmichael . | |
| 2,866,232 | 12/1958 | West et al. | 19/159 R |
| 2,940,136 | 6/1960 | Scott | 19/159 R |
| 3,035,313 | 5/1962 | Naegeli et al. | 19/288 |
| 3,324,515 | 6/1967 | West | 19/159 R |
| 3,362,049 | 1/1968 | Kiser | 19/288 |
| 4,208,762 | 6/1980 | Starling | 19/159 R X |
| 4,283,814 | 8/1981 | Ford et al. | 19/159 R |

FOREIGN PATENT DOCUMENTS

| | | | |
|---|---|---|---|
| 1209921 | 1/1966 | Fed. Rep. of Germany . | |
| 1510339 | 11/1969 | Fed. Rep. of Germany . | |
| 2353889 | 5/1975 | Fed. Rep. of Germany . | |
| 2721422 | 11/1978 | Fed. Rep. of Germany . | |
| 8000981 | 5/1980 | PCT Int'l Appl. | 19/159 R |
| 1164917 | 9/1969 | United Kingdom . | |
| 1507509 | 4/1978 | United Kingdom . | |

OTHER PUBLICATIONS

German Publication No. 1,859,977 published 10–1962.

*Primary Examiner*—Louis K. Rimrodt
*Assistant Examiner*—J. L. Olds
*Attorney, Agent, or Firm*—Spencer & Frank

[57] ABSTRACT

A sliver coiler includes a rotary head assembly, a trumpet mounted eccentrically in the rotary head assembly and a sliver support situated at a vertical distance above the rotary head assembly and arranged for guiding the sliver to the trumpet orbiting during rotation of the rotary head assembly. There is provided a hood which encloses a volume above the rotary head assembly and which has a ceiling wall provided with an air inlet opening. The sliver support is arranged in a zone of the ceiling wall.

13 Claims, 7 Drawing Figures

Fig. 4
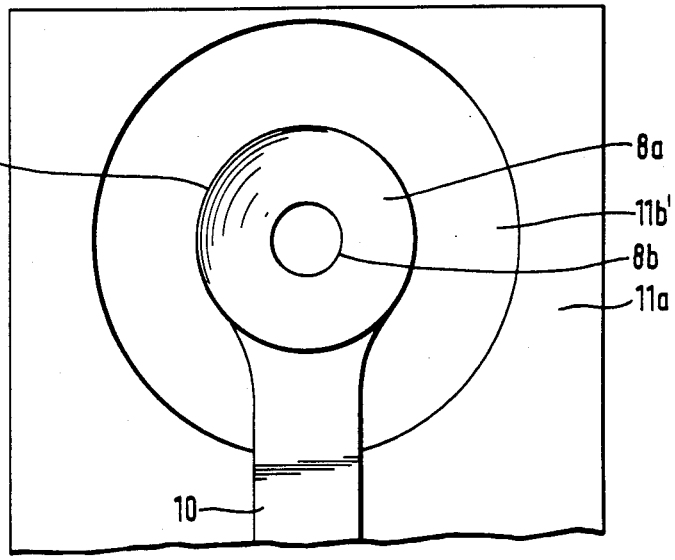
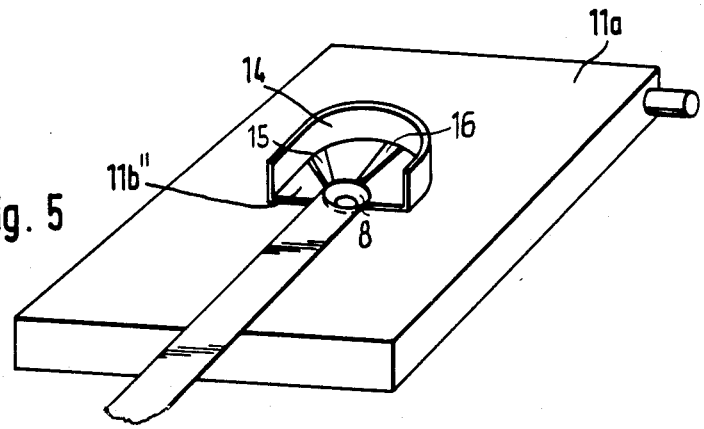
Fig. 5
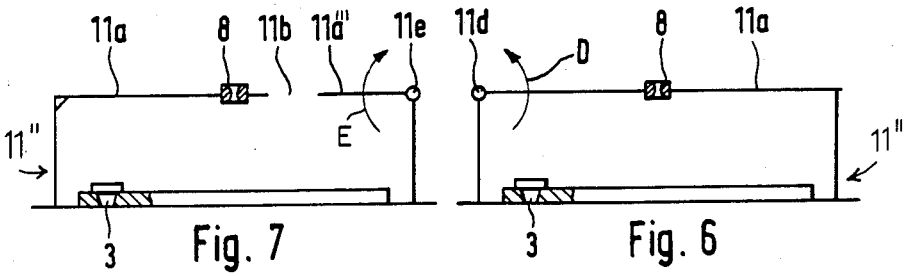
Fig. 7 Fig. 6

SLIVER COILER

BACKGROUND OF THE INVENTION

This invention relates to a sliver coiler including a support arrangement for positioning the running sliver as it is delivered by a carding machine, a rotary head assembly including an orbiting sliver trumpet through which the sliver passes as it runs from the support arrangement; and calender rollers arranged underneath the sliver trumpet and orbiting therewith. After the sliver passes through the calender rollers, it is deposited in continuous coils into a rotating coiler can disposed underneath the rotary head assembly.

In a known apparatus the sliver supporting arrangement includes a sliver deflecting roller which is situated above the rotary head assembly and which rotates about an approximately horizontal axis. The distance between the sliver deflecting roller and the rotary head assembly is greater than the radius of the rotary head assembly, and the angle of the connecting line between the trumpet and the roller to the (generally horizontal) plane in which the head assembly rotates is approximately 70°. In such an arrangement, at high sliver speeds of, for example, more than 300 m/min, the risks are high that the unsupported sliver significantly bulges outwardly under the effect of centrifugal forces and may rupture. It is a further disadvantage of the above-outlined known arrangement that in the zone of the sliver support arrangement dust and other impurities are released into the working hall of the fiber processing plant.

SUMMARY OF THE INVENTION

It is an object of the invention to provide an improved sliver coiler of the above-outlined type from which the discussed disadvantages are eliminated and which, in particular, permits high sliver speeds without the danger of sliver rupture and which also provides for the removal of dust, trash or the like.

This object and others to become apparent as the specification progresses, are accomplished by the invention, according to which, briefly stated, a hood is provided above the rotary head assembly and the sliver support arrangement above the rotary head assembly is accommodated within the hood in an upper zone thereof. The hood extends horizontally over at least one part of the sliver coiler and is provided with at least one air inlet opening.

An advantage of placing the sliver support arrangement in the vicinity of the ceiling of the hood resides in that the sliver portion momentarily situated in the zone of the support arrangement is not exposed to the air turbulence caused by the rotation of the rotary head assembly, since such sliver portion is situated in the upper part of the hood. For removing dust and other waste which is released particularly in the zone of the sliver support arrangement which, as will be described later, functions as a pre-densifier for the sliver, in the hood ceiling openings (slots) are provided through which the dust is admitted into the inside of the hoood and is removed therefrom by a suction device.

Preferably, the distance between the sliver support arrangement in the upper part of the hood and the rotary head assembly is equal to or is smaller than the radius of the rotary head assembly. In this manner, the sliver is guided at an acute angle to the horizontal between the sliver support arrangement above the rotary head assembly and the sliver trumpet. This arrangement ensures that the effect of the centrifugal force component which would normally cause a bulging of the unsupported portion of the sliver between the support arrangement and the sliver trumpet is significantly reduced. As a result, substantially higher operational speeds are possible, for example, in excess of 300 m/min, without risking rupture of the sliver. This avoids operational disturbances and increases the output rate.

According to a further feature of the invention, the sliver support arrangement comprises a dual trumpet-like guide element. The latter thus has the shape of back-to-back arranged funnels whose central constriction functions as a pre-densifier. Thus, as the sliver passes through the guide element, air is expelled from the sliver, resulting in a denser and more stable article which better resists rupture.

According to another feature of the invention, the air inlet opening provided in the hood ceiling is situated in the zone of the guide element. Such a construction ensures that dust is removed along a short path. Advantageously, the hood is coupled to a suction device so that dust, trash and other released waste may be directly removed.

According to a further feature of the invention, upstream of the trumpet-like guide element and the sliver support arrangement further includes at least one additional sliver supporting device which expediently is of a trough-like construction, which positively orients the sliver towards the trumpet-like guide element and further, the sliver is shielded by the trough from lateral air streams. Expediently, above the sliver support arrangement and the air inlet opening a common lid is provided which directs the released dust into the air inlet opening. Preferably, the lid (ceiling) zone of the hood is pivotal together with the sliver supporting arrangement so that access to the inside of the hood is provided which particularly facilitates the start-up operation (initial introduction of the sliver into the trumpet). According to a further feature of the invention, the sliver support arrangement (guide element) is disposed stationarily and the hood lid is mounted such that it may be pivoted away from the support arrangement. Such a construction is advantageous in that during the start-up operation only one component (the sliver trumpet) is in a displaced state.

According to a further feature of the invention, the hood has, on its top, an arcuate shield which surrounds the air inlet opening, particularly on that side which is oriented away from the zone where the sliver is introduced.

According to a further feature of the invention, a circularly (cylindrically) bent shielding element is provided within the hood about the rotary head assembly for preventing dust or other waste from gaining access to or settling in the corners of the hood. The space which is surrounded by the shielding element is preferably exposed to suction. In addition, by virtue of the circular or cylindrical shape of the shielding element, the flow-dynamic conditions set in part by the air stream of the rotary head plate which revolves at high speeds are improved and equalized.

BRIEF DESCRIPTION OF THE DRAWING

FIG. 4 is a top plan view of a component of another preferred embodiment.

FIG. 5 is a perspective view of a component of a further preferred embodiment.

FIG. 6 is a schematic side elevational view of another preferred embodiment of the invention.

FIG. 7 is a view, similar to FIG. 6, of still a further preferred embodiment of the invention.

DESCRIPTION OF THE PREFERRED EMBODIMENT

Figure 1:
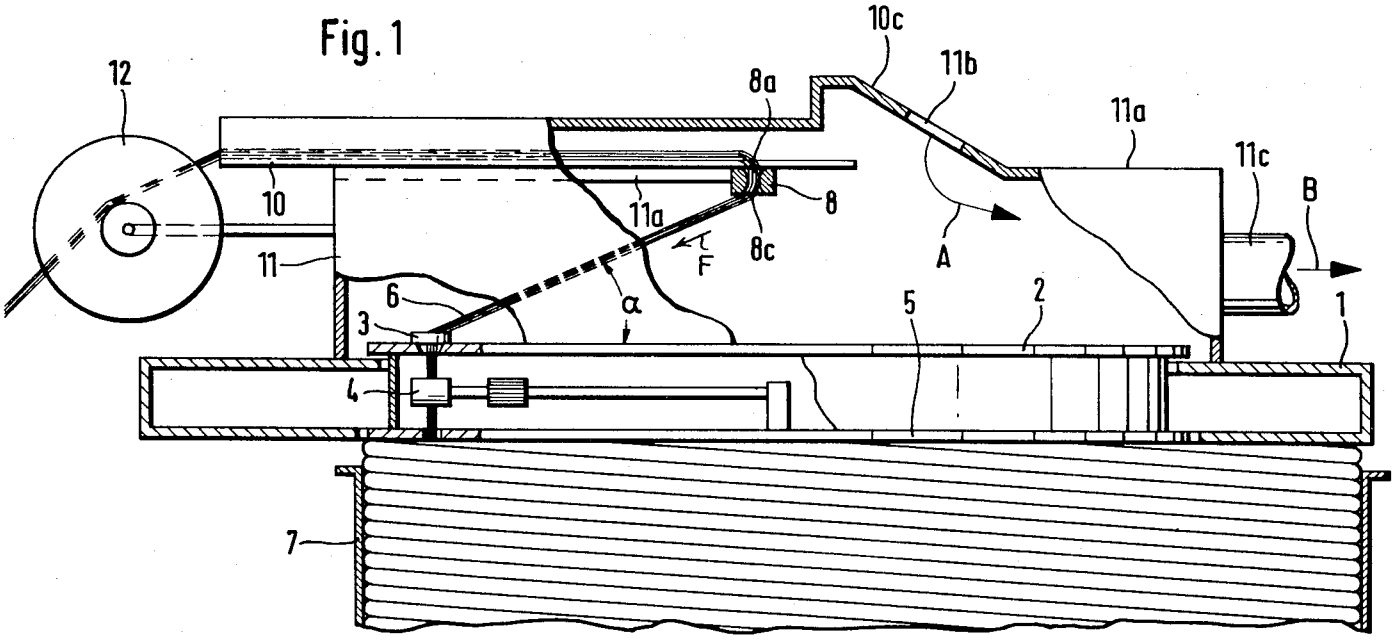
FIG. 1 is a schematic sectional elevational view of a preferred embodiment of the invention.

Turning to FIG. 1, there is shown therein a sliver coiling apparatus (sliver coiler) associated with a carding machine (not shown). The sliver coiler comprises a stationary head support plate assembly 1 carrying a rotary head assembly 2 in which a sliver trumpet 3, calender rollers 4 (only one is visible) and a pressure plate 5 are mounted for rotation with the head assembly 2. The underside of the pressure plate 5 is oriented essentially coplanar with the underside of the head support plate assembly 1. During normal operation of the apparatus, the supply rollers (calender rollers) 4 are driven such that the sliver 6 which is introduced into the rotary head assembly 2 through the trumpet 3, is deposited in a coiler can 7 which is positioned underneath the head support plate assembly 1 and the rotary head assembly 2. The coiler can 7 also rotates during deposition of the sliver 6 by the rotary head assembly 2. The uppermost coil of the deposited sliver 6 projects beyond the upper edge of the coiler can 7 and engages the essentially flat undersides of the head support plate assembly 1 and the pressure plate 5 during a major part of the can charging operation as well as subsequent to the completion thereof.

Above the head support plate assembly 1 there is arranged a hood 11 which is a box-like structure having a ceiling 11a and which extends over the rotary head assembly 2. In the ceiling 11a there is provided an air inlet opening **11*b* through which air is introduced in the inside of the hood 11 as indicated by the arrow A. In the lateral zone of the hood 11 there is provided an outlet opening 11*c* which is connected to a suction device (not shown) for withdrawing the air from the inside of the hood 11** as indicated by the arrow B.

A trumpet-like guide element 8, having the general shape of two back-to-back arranged funnels, is stationarily mounted in the ceiling **11*a*, approximately centrally above the rotary head assembly 2 and serves as a support for the running sliver 6. As viewed in the direction of sliver travel (arrow F), immediately upstream of the guide element 8, on the ceiling 11a there is formed a generally horizontally oriented trough 10 in which the sliver runs as it is delivered by the card and slightly deflected by a roller 12. The trough 10 guides the sliver 6 to the narrowing trumpet inlet 8*a* whereupon the sliver passes through a constriction 8*b* of the guide element 8 and leaves the latter through a flaring trumpet opening 8*c* while being deflected towards the trumpet 3 carried by the rotary head assembly 2. The line connecting the outlet 8*c* of the guide element 8 and the inlet of the trumpet 3 forms, with the plane of the horizontally oriented rotary head assembly 2, an angle $\alpha$ of approximately 30°. This results in a guidance and orientation of the sliver of relatively acute angle to the plane in which the head assembly 2 rotates, which significantly reduces a disadvantageous effect of centrifugal forces on the unsupported sliver portion between the guide element 8 and the trumpet 3. As the sliver 6 passes through the constriction 8*b*, air is expelled (pressed out) from the sliver 6** resulting in a densification and stabilization of the sliver, thus rendering the same less prone to rupture.

Figure 2:
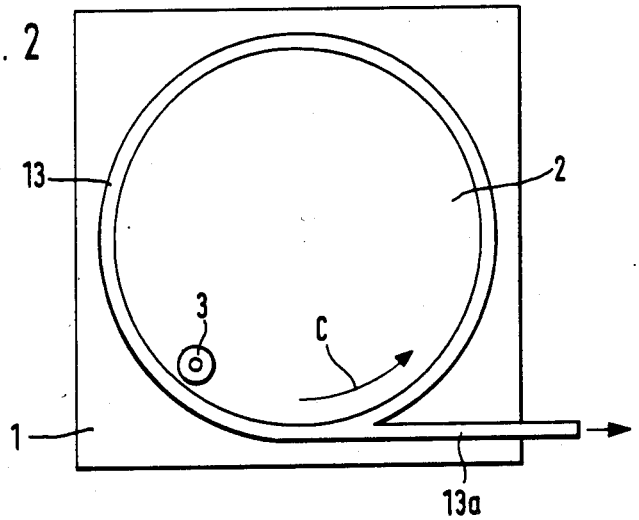
FIG. 2 is a schematic top plan view of one part of the structure shown in FIG. 1, illustrating a further component of the preferred embodiment.

Turning now to FIG. 2, there is shown, in top plan view, the rotary head assembly 2 supported in an angular casing. Inside the casing, about the rotary head assembly 2 there is provided a stationary cylindrical shielding element 13 which may be a sheet metal component and which is positioned edgewise upright on the head support plate assembly 1. The shielding element 13 is adjoined by a suction nipple **13*a* for removing dust. The arrow C indicates the direction of rotation of the rotary head assembly 2**.

Figure 3:
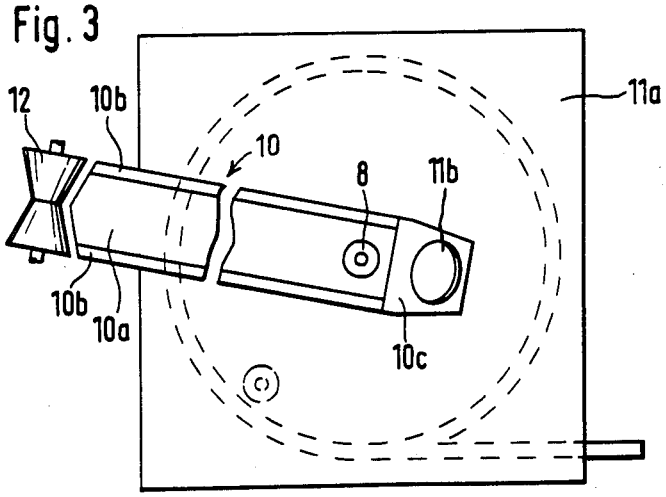
FIG. 3 is a top plan view of the construction shown in FIG. 1, illustrated on a reduced scale.

Turning now to FIG. 3, the trough 10 mounted on the top of the hood 11 has a bottom **10*a* and two slightly outwardly oriented wall surfaces 10*b*. The air outlet opening 11*b* is arranged in the ceiling 11*a*, on that side of the sliver guide element 8 which is oriented away from the trough 10. In this manner, dust or other particles flying in the direction of the ceiling 11a is directed into the air inlet opening 11*b***.

FIG. 4 illustrates the inlet zone **8*a* of the guide element 8 which tapers towards the constriction 8*b*. In this embodiment the air inlet opening 11*b*′ is provided in the ceiling 11*a* about the guide element 8**.

Turning now to FIG. 5, in the embodiment shown therein, about an arc-shaped air inlet opening **11*b*″ there is provided, on the cover (ceiling) 11*a*, an arcuately bent screen 14. The air inlet opening 11*b*″ is divided into three aperture zones by webs 15 and 16**.

Turning now to FIG. 6, the ceiling (lid) **11*a*′ is pivotally movable about a hinge 11d into an open position in the direction of the arrow D to provide manual access to the guide element 8 and the trumpet 3**, for example, for manipulations necessary for the start-up.

Turning to FIG. 7, the guide element 8 is stationarily secured in a non-movable ceiling part **11*a*″ of the hood 11″. Another ceiling part 11*a*‴ is displaceable between the air inlet opening 11*b* and a hinge 11*e* to be pivoted upwardly into an open position to provide access to the inside of the hood 11″**, as indicated by the arrow E.

It will be understood that the above description of the present invention is susceptible to various modifications, changes and adaptations, and the same are intended to be comprehended within the meaning and range of equivalents of the appended claims.

What is claimed is:

1. In a sliver coiler including a rotary head assembly having a radius and being arranged for rotation in a generally horizontal plane; a trumpet mounted eccentrically in said rotary head assembly; and a sliver supporting means situated at a vertical distance above said rotary head assembly and arranged for guiding the sliver to said trumpet orbiting during rotation of said rotary head assembly; the improvement comprising a hood enclosing a volume above the rotary head assembly; said hood having a ceiling wall provided with an air inlet opening; said sliver supporting means being stationarily affixed to and including a sliver inlet opening through which the sliver enters into said volume from an exterior or said hood; said air inlet opening and said sliver inlet opening being spaced from one another; further comprising suction means including an air outlet opening provided in said hood spaced from said sliver supporting means and from said inlet opening for removing air and dust immediately from said sliver supporting means in an upper part of said hood.

2. A sliver coiler as defined in claim 1, wherein the distance between said sliver supporting means and said rotary head assembly equals said radius at the most.

3. A sliver coiler as defined in claim 1, further comprising pivot means for swingably mounting said ceiling wall on said hood.

4. A sliver coiler as defined in claim 1, wherein said ceiling wall has a fixed portion carrying said sliver supporting means and a pivotally supported swingable portion.

5. A sliver coiler as defined in claim 1, wherein said sliver supporting means comprises a trumpet-like guide element.

6. A sliver coiler as defined in claim 5, wherein said air inlet opening is situated adjacent said guide element.

7. A sliver coiler as defined in claim 5, wherein said sliver supported means comprises a sliver support element affixed to an external top face of said hood and extending parallel to and on said top face; said sliver support element being arranged upstream of said trumpet-like guide element, as viewed in a direction of sliver run.

8. A sliver coiler as defined in claim 7, wherein said sliver support element comprises a trough.

9. A sliver coiler as defined in claim 8, wherein said sliver supporting means further comprises a sliver supporting roller disposed upstream of said trough and arranged for rotation about a horizontal axis.

10. In a sliver coiler including a rotary head assembly having a radius and being arranged for rotation in a generally horizontal plane; a trumpet mounted eccentrically in said rotary head assembly; and a sliver supporting means situated at a vertical distance above said rotary head assembly and arranged for guiding the sliver to said trumpet orbiting during rotation of said rotary head assembly; the improvement comprising a hood enclosing a volume above the rotary head assembly; said hood having a ceiling wall provided with an air inlet opening; said sliver supporting means being arranged in a zone of said ceiling wall; and a curved shielding member mounted on said hood and surrounding said air inlet opening.

11. In a sliver coiler including a rotary head assembly having a radius and being arranged for rotation in a generally horizontal plane; a trumpet mounted eccentrically in said rotary head assembly; and a sliver supporting means situated at a vertical distance above said rotary head assembly and arranged for guiding the sliver to said trumpet orbiting during rotation of said rotary head assembly; the improvement comprising a hood enclosing a volume above the rotary head assembly; said hood having a ceiling wall provided with an air inlet opening; said sliver supporting means being arranged in a zone of said ceiling wall; and a circularly bent shielding element disposed within said volume and surrounding said rotary head assembly.

12. In a sliver coiler including a rotary head assembly having a radius and being arranged for rotation in a generally horizontal plane; a trumpet mounted eccentrically in said rotary head assembly; and a sliver supporting means situated at a vertical distance above said rotary head assembly and arranged for guiding the sliver to said trumpet orbiting during rotation of said rotary head assembly; the improvement comprising a hood enclosing a volume above the rotary head assembly; said hood having a ceiling wall provided with an air inlet opening; said sliver supporting means being arranged in a zone of said ceiling wall; said sliver supporting means comprising a trumpet-like guide element and a sliver support element arranged upstream of said trumpet-like guide element, as viewed in a direction of sliver run, said air inlet opening partially surrounding said trumpet-like guide element on a side thereof oriented away from said sliver support element.

13. A sliver coiler as defined in claim 12 further comprising a sheet-like, curved shielding element partially surrounding said air inlet opening.

* * * * *